US009155376B2

(12) United States Patent
Moreau et al.

(10) Patent No.: US 9,155,376 B2
(45) Date of Patent: Oct. 13, 2015

(54) TOOL LANYARD WRIST CUFF

(71) Applicant: Ty-Flot, Inc., Manchester, NH (US)

(72) Inventors: Darrell A. Moreau, Manchester, NH (US); Andre W. Moreau, Spring Hill, FL (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/297,935

(22) Filed: Jun. 6, 2014

(65) Prior Publication Data

US 2015/0164204 A1 Jun. 18, 2015

Related U.S. Application Data

(63) Continuation-in-part of application No. 14/132,013, filed on Dec. 18, 2013.

(51) Int. Cl.

| | |
|---|---|
| ***A45F 5/00*** | (2006.01) |
| ***A45F 5/02*** | (2006.01) |
| *B25F 5/00* | (2006.01) |

(52) U.S. Cl.

CPC ..... *A45F 5/00* (2013.01); *A45F 2005/006* (2013.01); *A45F 2005/008* (2013.01); *A45F 2200/0575* (2013.01)

(58) Field of Classification Search

CPC ..... A45F 5/00; A45F 2005/008; A45F 2005/006; A45F 2200/0575; A45F 5/02; A45F 5/004; A45F 5/021; A45F 2003/006; A45F 3/14; A63C 11/222; A45C 13/20; A45C 13/30; A45B 2009/025; A41D 19/0048; A44C 5/0007; A44C 5/0038; A44C 5/0053; A62B 35/0031; B25B 23/00; Y10S 224/904; Y10S 224/914

See application file for complete search history.

(56) References Cited

U.S. PATENT DOCUMENTS

| | | | | | |
|---|---|---|---|---|---|
| 272,067 | A | * | 2/1883 | Lindsay | 224/220 |
| 2,522,719 | A | * | 9/1950 | Johnson | 224/220 |
| 2,553,317 | A | * | 5/1951 | Hill | 224/221 |
| 2,661,888 | A | * | 12/1953 | Sidlinger | 182/3 |
| 2,970,729 | A | * | 2/1961 | Allen | 294/149 |
| 2,994,300 | A | * | 8/1961 | Grahling | 119/770 |
| 3,232,632 | A | * | 2/1966 | Lewis | 280/822 |
| 3,294,299 | A | * | 12/1966 | Brennan | 224/220 |
| 3,854,640 | A | * | 12/1974 | Willmarth | 224/220 |
| 4,047,651 | A | * | 9/1977 | McMullen | 224/168 |
| 4,135,653 | A | * | 1/1979 | Sieloff | 224/222 |
| 4,234,202 | A | * | 11/1980 | Loffelholz | 280/820 |
| 4,315,641 | A | * | 2/1982 | Larsen | 280/822 |
| 4,489,867 | A | * | 12/1984 | Schwemberger | 224/222 |
| 4,728,123 | A | * | 3/1988 | Kassal et al. | 280/822 |
| 4,862,563 | A | * | 9/1989 | Flynn | 24/442 |

(Continued)

FOREIGN PATENT DOCUMENTS

GB 2353752 A 3/2001

*Primary Examiner* — Bobby Muromoto, Jr.

(74) *Attorney, Agent, or Firm* — Robert R. Deleault, Esq.; Mesmer & Deleault, PLLC

(57) ABSTRACT

A tool lanyard wrist cuff includes a fixed closed loop band and an adjustment tab extending therefrom. A second fastener part releasably engages a first fastener part when the adjustment tab is folded with a tab inside surface against a loop outside surface. A lanyard connector assembly includes a lanyard connector, a breakaway lanyard connector strap releasably connected to the closed loop band by a releasable fastener and fixedly connected at a first end to the adjustment tab or the closed loop band adjacent the adjustment tab.

16 Claims, 11 Drawing Sheets

(56) References Cited

U.S. PATENT DOCUMENTS

| | | | | | |
|---|---|---|---|---|---|
| 4,897,768 | A * | 1/1990 | Thul | 362/191 |
| 4,958,758 | A * | 9/1990 | Tipple et al. | 224/267 |
| 5,082,156 | A * | 1/1992 | Braun | 224/220 |
| 5,130,899 | A * | 7/1992 | Larkin et al. | 362/570 |
| 5,154,506 | A * | 10/1992 | Leard | 362/103 |
| 5,257,729 | A * | 11/1993 | Silvernail | 224/219 |
| 5,309,328 | A * | 5/1994 | Lum | 361/809 |
| 5,374,919 | A * | 12/1994 | Zelka et al. | 340/574 |
| 5,593,073 | A * | 1/1997 | Finnegan | 224/183 |
| 5,664,712 | A * | 9/1997 | Smrt | 224/250 |
| 5,894,971 | A * | 4/1999 | Huang | 224/218 |
| 5,915,336 | A * | 6/1999 | Watson | 119/797 |
| 6,095,093 | A * | 8/2000 | Kisko et al. | 119/770 |
| 6,113,565 | A * | 9/2000 | Schlup et al. | 602/62 |
| 6,216,319 | B1 * | 4/2001 | Elkins | 24/3.2 |
| 6,502,862 | B1 * | 1/2003 | Lenhart | 280/821 |
| 6,553,944 | B1 * | 4/2003 | Allen et al. | 119/769 |
| 6,776,317 | B1 * | 8/2004 | Parker | 224/251 |
| 6,807,680 | B2 * | 10/2004 | Sloot | 2/16 |
| 7,048,162 | B2 * | 5/2006 | Frye et al. | 224/222 |
| 8,210,406 | B2 * | 7/2012 | Moreau et al. | 224/221 |
| 8,413,613 | B1 * | 4/2013 | Smith | 119/797 |
| 2004/0084489 | A1 * | 5/2004 | Murphey et al. | 224/221 |
| 2007/0119884 | A1 * | 5/2007 | Moreau et al. | 224/251 |
| 2008/0072844 | A1 * | 3/2008 | Konigsberg | 119/770 |
| 2009/0235873 | A1 * | 9/2009 | Gould et al. | 119/770 |
| 2009/0272775 | A1 * | 11/2009 | Moreau et al. | 224/251 |
| 2009/0294495 | A1 * | 12/2009 | Moreau et al. | 224/219 |
| 2010/0032465 | A1 * | 2/2010 | Moreau et al. | 224/660 |
| 2010/0133306 | A1 * | 6/2010 | Monroe | 224/219 |
| 2012/0042436 | A1 * | 2/2012 | Jenkin | 2/158 |
| 2012/0247994 | A1 * | 10/2012 | Moreau et al. | 206/373 |

* cited by examiner

TOOL LANYARD WRIST CUFF

BACKGROUND OF THE INVENTION

1. Field of the Invention

The present invention relates generally to tool lanyards. Particularly, the present invention relates to tool lanyards attached to a user's wrist.

2. Description of the Prior Art

Persons engaged in repair and construction type work ordinarily have to use a variety of hand tools to perform tasks. The work commonly takes place over machinery and/or on platforms at various heights above the ground.

People engaged in such work have many reasons to avoid dropping tools. For instance, a dropped tool must be picked up before a person can continue using it to complete a particular task. This entails wasted time and energy in climbing down from a considerable height just to pick up the tool. Oftentimes, the dropped tool will land in a place out of the user's sight. In those circumstances, a search must be undertaken to locate the tool. This further increases the amount of wasted time in retrieving a dropped tool.

Another, more serious concern with the use of hand tools (i.e. hammers, screw drivers, pliers, ratchets, levels, flashlights, tape measures, etc.) occurs when working in overhead situations. If dropped, the hand tool could injure personnel and/or damage equipment located beneath where the work is being performed. A dropped tool exposes persons located below to potential injury or even death if struck by the falling tool. A dropped tool also has the potential to cause damage to machinery located below. The damage can result in many ways. For instance, the damage can be due to the impact of the falling tool on the machinery or parts. Where machinery is operating at the time, the falling tool may come to rest in the path of moving components causing damage to the components and/or necessitating that the machinery be shut down.

While without doubt, persons using hand tools try to maintain sufficient grip on the tool, conditions are practically certain to arise in which tools will be dropped. Moisture from sweating frequently makes it difficult to maintain the necessary grip on the tool handle. Muscular fatigue can cause a person's grip to loosen without consciously realizing it. In reaction to an unexpected slip, the person may unconsciously drop the tool in grabbing for some support structure to prevent or cushion the fall.

Many attempts have been made to overcome the hazards of dropped tools. Makeshift lanyards, such as those made with rope and/or string and fastened with duct tape, have infamously been used to create wrist lanyards and tethers to keep a specific tool attached to the user's arm or wrist.

More conventional tool lanyards used to tether hand tools are typically adjustable and are made of a rope or string. The size of these lanyards can be adjusted to the user's wrist with the use of a cord lock that slides along the rope. This style of lanyard can be uncomfortable to the user and must be replaced often due to lack of wear resistance inherent in rope.

Another style of adjustable lanyards is a lanyard manufactured with webbing sewn to hook-and-loop fasteners and that include a hardware loop (or equivalent) that can be used as a cinching point to tighten the lanyard around the user's wrist. A problem with such a style of lanyard is that, if not used properly, the lanyard requires two hands to fasten it to the user's wrist or one hand used to wedge it against the user's body while using the other hand to cinch it around the user's wrist. In either situation, these lanyards are very cumbersome to install on the user's wrist.

Other styles of wrist cuff tool lanyards are manufactured from a stretch nylon fabric or equivalent that will slightly expand to allow the wrist cuff to expand and slide over the user's wrist. The expansion ratio of the stretch nylon cannot be too excessive because weight applied to the nylon while the lanyard is in use will tend to expand the wrist cuff and cause the wrist cuff to slide over the user's hand. With this style, multiple sizes of wrist cuffs must be made available to fit a range of wrist sizes.

Examples of prior art lanyard devices are disclosed. U.S. Pat. No. 4,728,123 (1988, Kassal et al.) discloses a releasable strap system. The releasable strap system includes the combination of a hand strap and a device strap. The hand strap is removably connectable around the wrist of a hand and between two of the five fingers of the hand, leaving the hand free for normal use. The hand strap includes two portions, a straight wrist portion and a curved looped portion. The curved loop portion has two ends connected to the straight wrist portion at separated intervals. The straight wrist portion is wrapped around the wrist of the user, threaded through a ring, tightened, and then folded back and locked in position. The device strap is removably connected to the hand strap for supporting an item not held in the user's hand and for quick release from the hand strap.

U.S. Pat. No. 5,130,899 (1992, Larkin et al.) discloses a tool restraint apparatus. The tool restraint includes an elongate elastomeric tether line with respective first and second flexible straps mounted to each end. The first web strap is arranged for selective securement about a user's wrist and includes a first and second end that includes first and second hook-and-loop fastener patches that permit securement of the hook-and-loop fastener patches together. The second web strap is similarly constructed like the first web strap.

U.S. Pat. No. 5,082,156 (1992, Braun) discloses a tool wrist strap that has a band, a looped cord, and a clench bead on the cord. The band is made of a flexible elastic fabric material and formed by an elongate strip having opposite ends attached together. The band is adapted to fit loosely about a person's wrist. The looped cord is composed of flexible inelastic material and has a looped end portion and a pair of opposite ends attached to the band adjacent to one another. The clench bead is slidable on the looped cord and produces sufficient friction to hold the bead in any given position along the cord.

U.S. Pat. No. 8,210,406 (2012, Moreau et al.) discloses a tool lanyard wrist cuff. The tool lanyard wrist cuff includes a fixed, closed loop band having a first mating portion of a fastening mechanism fixedly attached to an outside surface of the closed loop band. There is an adjustment tab extending from the fixed, closed loop band where the adjustment tab has a second mating portion of the fastening mechanism. The second mating portion is configured for releasable engagement with the first mating portion when the fixed closed loop band is folded onto itself positioning the adjustment tab over and onto the outside surface of the closed loop band. A lanyard retaining component is integrally formed on the outside surface of the closed loop band.

SUMMARY OF THE INVENTION

Unfortunately, the lanyard devices of the prior art fail to address the hazards associated with a tool lanyard used in proximity to machines with moving or rotating parts. When a lanyard that is connected to the user's wrist or hand becomes caught on moving parts of a machine, it can pull the user's arm into the equipment and cause severe injury. The risk of severe injury is heightened because prior art wrist cuffs and lanyard devices fail to break away from the user or allow the wrist cuff to easily slide off of the user's wrist when subjected to a large pulling force, such as when being caught in a machine. A similar risk of injury is present in other situations, such as when the lanyard unexpectedly catches on a structure as a worker jumps or rapidly descends from an elevated position.

Therefore, what is needed is a tool lanyard wrist cuff that will break away from the user's wrist when subjected to a force that exceeds the drop capacity of the cuff.

It is an object of the present invention to provide a wrist lanyard that fits a range of wrist sizes. It is another object of the present invention to provide a wrist cuff for use with tool lanyards. It is a further object of the present invention to provide a wrist cuff that can break away or disengage from the user's wrist when subjected to an adequate pulling force on the lanyard.

The present invention achieves these and other objectives by providing a tool lanyard wrist cuff having a fixed closed loop band and an adjustment tab extending from the closed loop band. The closed loop band has a first fastener part of a releasable fastener fixedly attached to a loop outside surface. The adjustment tab has a tab inside surface, a tab outside surface, and a distal end portion. A second fastener part of the releasable fastener is fixedly attached to the tab inside surface of the distal end portion and configured for releasable engagement with the first fastener part when the adjustment tab is folded with the tab inside surface against the loop outside surface to position the second fastener part in engagement with the first fastener part. A breakaway lanyard connector strap is fixedly connected at a first end to the adjustment tab or the closed loop ban and releasably connected adjacent a second end to the fixed closed loop band by a connector strap releasable fastener. A first connector fastener part of the connector strap releasable fastener is fixedly attached to the breakaway lanyard connector strap and a second connector fastener part of the connector strap releasable fastener is fixedly attached to the closed loop band. A lanyard connector is secured to the breakaway lanyard connector strap. The position of the lanyard connector is critical to the purpose of the present invention to permit release of the adjustment tab when the lanyard connector is subjected to a predefined pull force.

In another embodiment, the releasable fastener and/or the connector strap releasable fastener is a snap, a snap button, or a hook-and-loop fastener. In another embodiment, the first connector fastener part is a portion of the first fastener part of the releasable fastener of the tool lanyard wrist cuff.

In another embodiment, the closed loop band includes a length of a stretchable material between the first fastener part and the adjustment tab. In one embodiment, the stretchable material comprises elastic.

In still another embodiment, the breakaway lanyard connector strap is made of a material having elastic properties.

In another embodiment of the tool lanyard wrist cuff, a retaining strip has a first strip end and a second strip end. The first strip end is fixedly attached to a first end of the breakaway lanyard connector strap and a second end is fixedly attached to the tab outside surface of the adjustment tab or the closed loop band adjacent the adjustment tab.

In another embodiment, the closed loop band is openable when subjected to a predefined lanyard pull force, which is greater than the pull force generated when a tool is inadvertently dropped. In one such embodiment, a first body end of the closed loop band is openably attached to a body portion of the tool lanyard wrist cuff using a connector such as breakaway stitching, one or more snaps, or one or more snap buttons that release when a lanyard exerts a pull force that is greater than the pull force of a dropped hand tool.

In a further embodiment, the retaining strip is made of a material having elastic properties.

In another aspect of the present invention, a method of making a tool lanyard wrist cuff includes the steps of folding a strip of material onto itself where a first body end of the strip is spaced from a distal end of the strip, attaching the first body end of the strip to the strip of material forming a closed loop and a tab with a distal end extending from the closed loop, securing a first fastener part to an outside surface of the closed loop, securing a second fastener part to an inside surface of the distal end portion of the tab, attaching a lanyard connector to a breakaway lanyard connector strap forming a closed loop that passes through one or more strap openings of the lanyard connector, fixedly attaching a first end of the breakaway lanyard connector strap to the adjustment tab or the closed loop band, and releasably attaching the breakaway lanyard connector strap to the tab, the closed loop band or both.

In another embodiment, the method includes the step of selecting the first fastener part, the second fastener part, the first connector fastener part, and the second connector fastener part from releasable fasteners including, but not limited to, a snap, a snap button, a hook-and-loop fastener, and the like.

In another embodiment of the method, the step of attaching the first body end to the strip material includes fixedly attaching the first body end to the strip material.

In another embodiment of the method, the step of attaching the first body end includes openably attaching the first body end to the strip material. For example, the first body end is openably attached to the strip material using one or more snaps, break-away stitching, or other openable means that release when a lanyard exerts a pull force that is greater than the pull force of a dropped hand tool.

In yet another embodiment of the method, the step of attaching the first body end to the strip material includes selecting an openable means requiring a predefined release force where the openable means releases when a lanyard exerts a pull force that is greater than the pull force of a dropped hand tool.

In yet another embodiment of the method, the step of fixedly attaching a first end of the breakaway lanyard connector strap to the adjustment tab or the closed loop band adjacent to the adjustment tab includes fixedly attaching a retaining strip between the adjustment tab and a first end of the breakaway lanyard connector strap where a first strip end is fixedly attached to the first end of the breakaway connector strap and a second strip end is fixedly attached to the adjustment tab or the closed loop band adjacent to the adjustment tab.

In yet another embodiment of the method, the step of releasably attaching the breakaway lanyard connector strap to the adjustment tab includes attaching a first additional fastener part of an additional releasable fastener to the adjustment tab and attaching a second additional fastener part of the additional releasable fastener to the breakaway lanyard connector strap.

DETAILED DESCRIPTION OF THE PREFERRED EMBODIMENT

As used herein, the term "fixed closed loop" means that the size of the closed loop is fixed regardless of whether the loop is openable or non-openable.

As used herein, the term "open position" means the fixed closed loop is an unwrapped orientation.

As used herein, the term "closed position" means the fixed closed loop is in a wrapped orientation.

As used herein, the term "wrapped orientation" means the fixed closed loop folds on itself.

Figure 1:
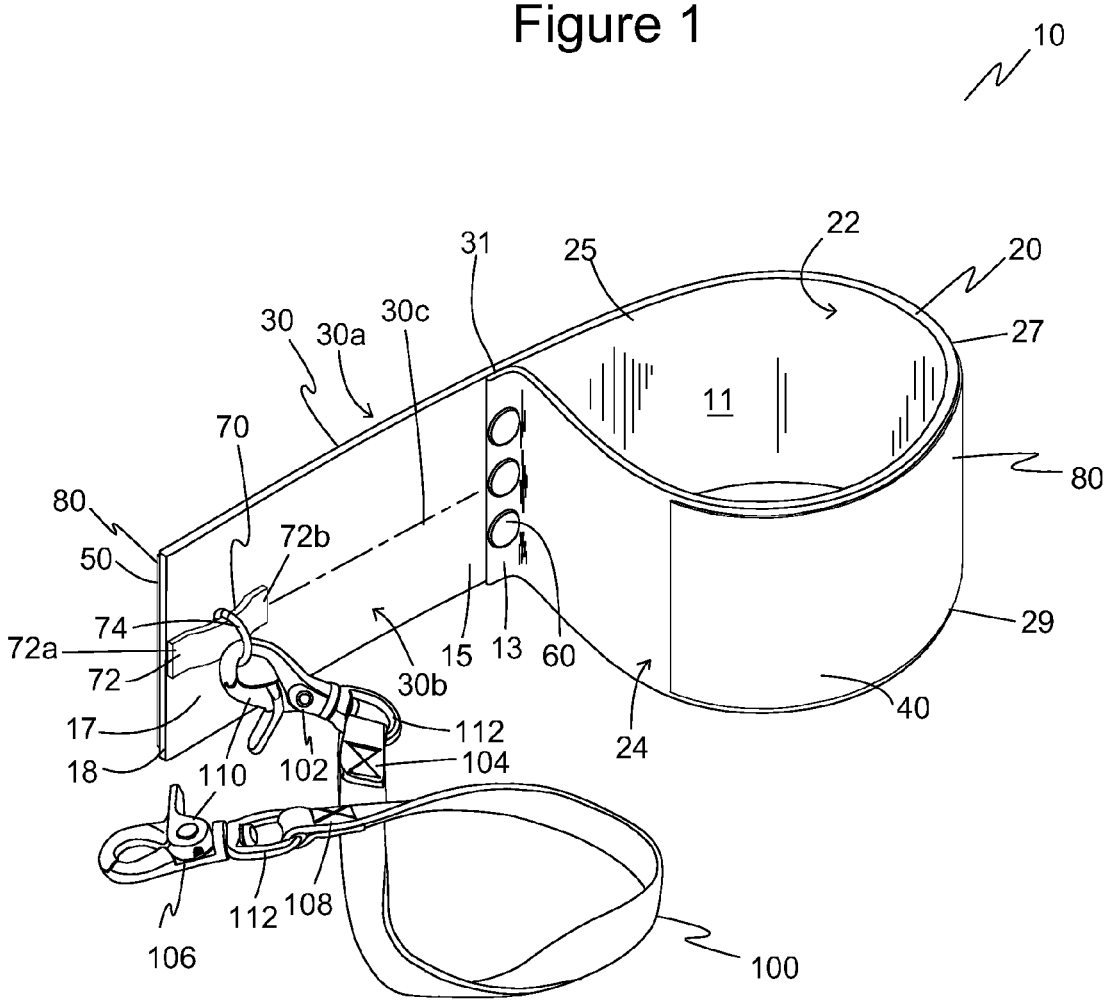
FIG. 1 is a perspective view of one embodiment of the present invention showing the tool lanyard wrist cuff in an open position with a lanyard attached to the lanyard connector.

The preferred embodiment(s) of the present invention is illustrated in FIGS. 1-15. FIG. 1 illustrates one embodiment of a tool lanyard wrist cuff 10 of the present invention shown in an open position. Tool lanyard wrist cuff 10 has a body portion 11 extending longitudinally between a first body end 13 and a distal end 18. In one embodiment, tool lanyard wrist cuff 10 defines a permanently fixed, closed loop band 20 and an adjustment tab 30 that extends from closed loop band 20 at a junction point 31. First body end 13 may be attached to body portion 11 using fixed loop fastener(s) 60. Fixed loop fastener(s) 60 in one embodiment are stitching, staples, rivets, grommets, adhesive, or the like. Closed loop band 20 has an inside loop surface 22 and a loop outside surface 24. Adjustment tab 30 has a tab inside surface 30*a* and a tab outside surface 30*b*. Closed loop band 20 is made of a flexible, pliable material, such as a nylon or cotton fabric strap or the like.

Figure 2:
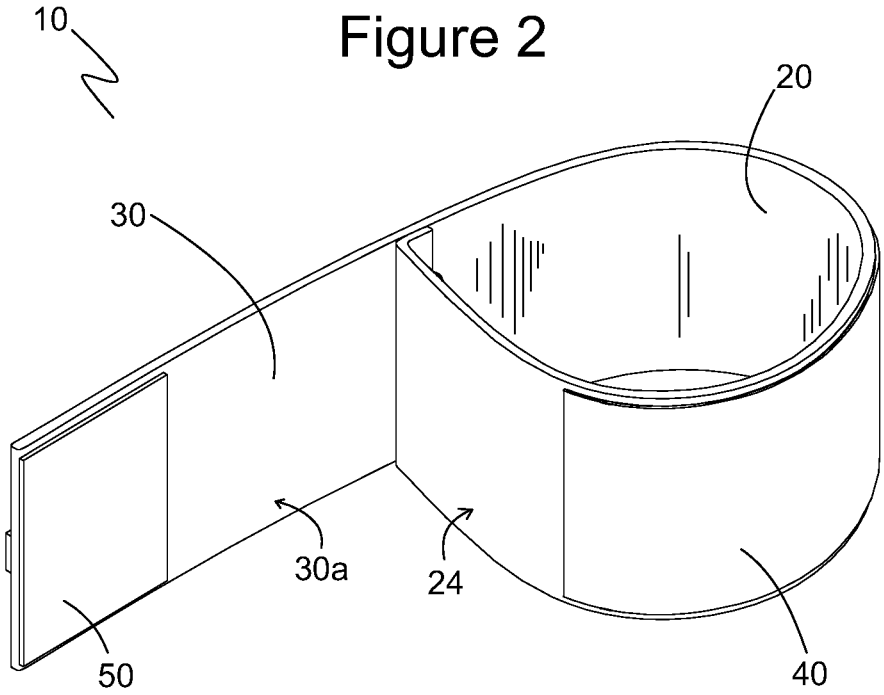
FIG. 2 is a perspective view of another embodiment of the present invention showing the first body end attached to the body portion in a direction extending away from the adjustment tab and showing the inside surface of the adjustment tab reversed compared to the embodiment of FIG. 1.

A releasable fastener 80 is fixedly attached to tool lanyard wrist cuff 10 and includes a first fastener part 40 and a second fastener part 50 (shown more fully in FIG. 2). First fastener part 40 is fixedly attached to loop outside surface 24. Second fastener part 50 is fixedly attached to inside tab surface 30*a* (shown more fully in FIG. 2) of adjustment tab 30. Although various releasable fastening devices can be used, a hook-and-loop fastener is preferred to enable attaching and adjusting tool lanyard wrist cuff 10 to a user's wrist 300 (shown in FIG. 11). One or more snaps or snap buttons are also acceptable for use as releasable fastener 80 (see FIG. 12, discussed below).

First fastener part 40, preferably the loop part of hook-and-loop fastener, is fixedly attached to loop outside surface 24, preferably by stitching. In one embodiment, first fastener part 40 of releasable fastener 80 extends from junction point 31 along all or part of loop outside surface 24. Preferably, first fastener part 40 extends substantially from first margin 27 to second margin 29 of tool lanyard wrist cuff 10. In other embodiments, first fastener part 40 extends only along a portion of loop outside surface 24 and is positioned as needed for the desired wrist size adjustment of closed loop band 20. In still other embodiments, a plurality of individual, spaced or non-spaced strips may be used instead of a single, elongated piece of first fastener part 40. Mating or second fastener part 50, preferably the hook part of a hook-and-loop fastener, is fixedly attached to an inside tab surface 30*a* of adjustment tab 30, also preferably by stitching. Similar to first fastener part 40, second fastener part 50 preferably extends substantially from first margin 27 to second margin 29 of tool lanyard wrist cuff 10. Second fastener part 50 of releasable fastener 80 is configured to align with and engage first fastener part 40 when closed loop band 20 is folded upon itself with inside tab surface 30*a* of adjustment tab 30 extending to face loop outside surface 24 of closed loop band 20.

Adjustment tab 30 may be a separate component attached to closed loop band 20 or it may be an extension of closed loop band 20. When adjustment tab 30 is an extension of closed loop band 20, first body end 13 is fixedly attached at a predefined location on body portion 11 to define junction point 31 and defining adjustment tab 30 and closed loop band 20. Adjustment tab 30 is the remaining portion of body portion 11 that extends beyond closed loop band 20. When adjustment tab 30 is a separate component, it is fixedly attached to closed loop band 20 or to an extension thereof. Optionally, closed loop band 20 is configured to open, where first body end 13 separates from body portion 11 when adjustment tab 30 exerts a predefined pulling force that is greater than the force exerted by a dropped tool. This optional feature is an important added safety feature that allows closed loop band 20 to be removed from the user's wrist in emergency situations.

Adjustment tab 30 has a proximal end portion 15 positioned at or adjacent to junction point 31 with closed loop band 20. A distal end portion 17 of adjustment tab 30 terminates at a distal end 18 positioned and extending away from closed loop band 20. Second part 50 of releasable fastener 80 is secured to inside tab surface 30*a* of adjustment tab 30 on distal end portion 17 and preferably extends to distal end 18.

As illustrated in FIGS. 1-2, inside tab surface 30*a* of adjustment tab 30 may be selected as desired so that adjustment tab 30 wraps in a chosen direction around closed loop band 20.

A lanyard attachment assembly 70 is attached to outside tab surface 30*b* of distal end portion 17 of adjustment tab 30. In one embodiment, lanyard attachment assembly 70 includes a ring retaining strip 72 that captures a lanyard connector 74. Lanyard attachment assembly 70 is attached at or near distal end 18 of adjustment tab 30. The location of lanyard attachment assembly 70 is one of the important features of the present invention. In one embodiment, a first end 72*a* of retaining strip 72 is fixedly attached at or near distal end 18 with retaining strip 72 extending longitudinally along adjustment tab 30 towards closed loop band 20. A second end 72*b* of retaining strip 72 is preferably fixedly attached a predefined distance from distal end 18, preferably along a longitudinal center line 30*c* of adjustment tab 30. In another embodiment, retaining strip 72 extends transversely (e.g., perpendicularly) to longitudinal center line 30*c* of adjustment tab 30 and is fixedly attached on distal end portion 17, preferably adjacent distal end 18. In one embodiment, lanyard attachment assembly 70 is substantially centered opposite second fastener portion 50 between margins 27, 29.

In another embodiment, lanyard connector 74 is a D-ring that is fixedly attached to distal end portion 17 of adjustment tab 30. Lanyard connector 74 may be attached by securing a portion of the D-ring (e.g., a straight section) between layers of fabric or between second fastener portion 50 and the material of adjustment tab 30. In this embodiment, the curved portion of the D-ring extends or is capable of pivoting to extend over distal end portion 17 opposite of second fastener portion 50.

An optional lanyard 100 is connected to lanyard connector 74. Lanyard 100 includes a first connector 102 connected to a first lanyard end 104 and a second connector 106 connected to a second lanyard end 108. As shown in FIG. 1, connectors 102, 106 are spring clips 110 with a rotatable eyelet 112.

The location of lanyard attachment assembly 70 is a critical feature of the present invention. When lanyard attachment assembly 70 is attached near distal end 18 of adjustment tab 30, a pulling force on lanyard connector 74 that exceeds the separation force of first and second fastener portions 40, 50 will tend to disengage second fastener portion 50 from first fastener portion 40. This is important for users that work near or around machinery having turning and/or rotating components. If a lanyard attached to the tool lanyard wrist cuff gets caught in the turning and/or rotating components, a user's hand, wrist and/or arm may be pulled into the turning and/or rotating component and cause serious injury. Thus, when tool lanyard wrist cuff 10 is installed on the user's wrist 300 in its closed position with first and second fastener portions 40, 50 engaged (shown in FIG. 11), a pulling force on lanyard connector 74 that exceeds the separation force of releasable fastener 80 will tend to convert tool lanyard wrist cuff 10 to its open position (shown in FIG. 1) and loosen closed loop band 20 on the user's wrist. Closed loop band 20 in its loosened, open position more freely slips over the user's hand, therefore preventing serious injury to the user. The separation force of releasable fastener 80 may be determined by choosing releasable fastener 80 of a particular type, a particular size, a particular quantity, or a combination of these factors.

In one embodiment, an overlapped portion 25 of closed loop band 20 between first part 40 of releasable fastener 80 and junction point 31 with adjustment tab 30 is made of a stretchable material, such as fabrics comprising elastic. In this embodiment, when first and second fastener parts 40, 50 of releasable fastener 80 are disengaged, closed loop band 20 more easily can slip over the user's hand due to the ability of closed loop band to expand in size as permitted by the stretchable material of overlapped portion 25. In its closed position, however, the non-stretchable or minimally stretchable material of adjustment tab 30 extends over overlapped portion 25 and engages first fastener part 40, therefore overriding the stretching ability of overlapped portion 25 and enabling closed loop band 20 to maintain a fixed size on the user's wrist. The ability of closed loop band 20 in its open position to further loosen on the user's wrist due to stretching overlapped portion 25 additionally prevents injury to the user.

In another embodiment, first body end 13 is releasably connected to body portion 11 using one or more fixed loop fasteners 60 that are optionally releasable. In one embodiment, fixed loop fastener(s) 60 are snaps, break-away stitching, or other releasable fastener chosen with a separation force substantially the same as that of releasable fastener 80. In such an embodiment, a sufficient force pulling on lanyard attachment assembly 70 will disengage first fastener part 40 from second fastener part 50 to loosen closed loop band 20. The force will further separate first body end 13 from body portion 11 by disengaging releasable fixed loop fastener(s) 60. Accordingly, tool lanyard wrist cuff 10 will become an open strap that freely separates from the user's wrist 300, thereby preventing injury to the user. Thus, this optional feature is an important additional safety feature of the present invention. Such an embodiment is discussed in more detail below with reference to FIGS. 10A and 10B.

In a further embodiment that incorporates a first body end 13 that is releasably connected to body portion 11, the pulling force on lanyard connector 74 that exceeds the separation force of releasable fastener 80 will tend to convert tool lanyard wrist cuff 10 to its open position (shown in FIG. 1) and loosen closed loop band 20 on the user's wrist. Fixed loop fastener(s) 60 used in forming a releasable first body end 13 from body portion 11 are selected in this embodiment to require a separation force that is greater than that of releasable fastener 80. In this embodiment, requiring a greater separation force for releasable fixed loop fastener(s) 60 than for releasable fastener 80 prevents complete separation from the user's wrist when only a tool is inadvertently dropped while complete separation is achieved with the tool lanyard catches in a piece of rotating machinery or in other situations where complete separation is required to prevent serious injury.

Figure 3:
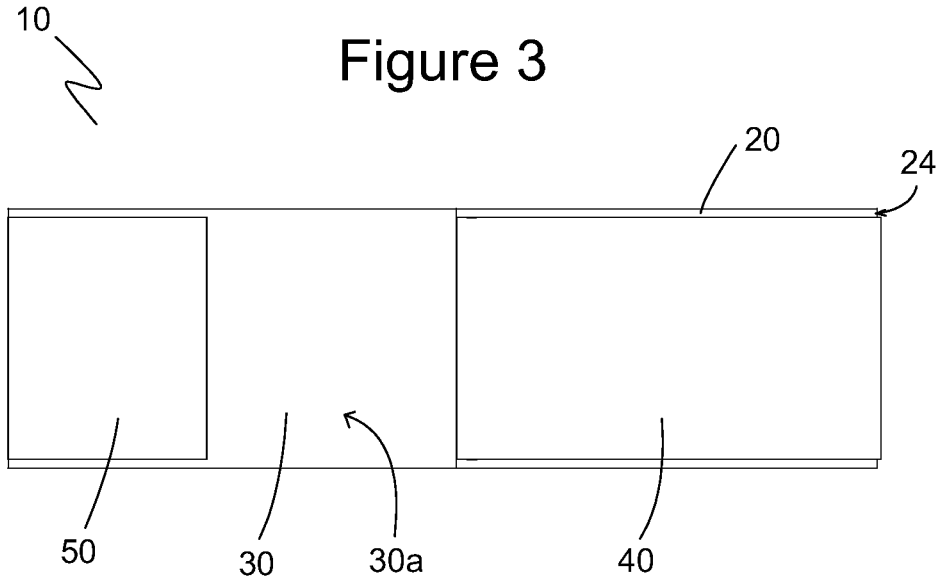
FIG. 3 is an elevational view of the embodiment of FIG. 2.

Referring now to FIGS. 2 and 3, another embodiment of tool lanyard wrist cuff 10 is shown in perspective and elevational views, respectively. Tool lanyard wrist cuff 10 includes closed loop band 20 and adjustment tab 30. First fastener portion 40 is fixedly attached to loop outside surface 24. Second fastener portion 50 is fixedly attached to tab inside surface 30*a*. As shown in FIG. 2, tab inside surface 30*a* is on the opposite side of adjustment tab 30 than as shown in FIG. 1.

Figure 4:
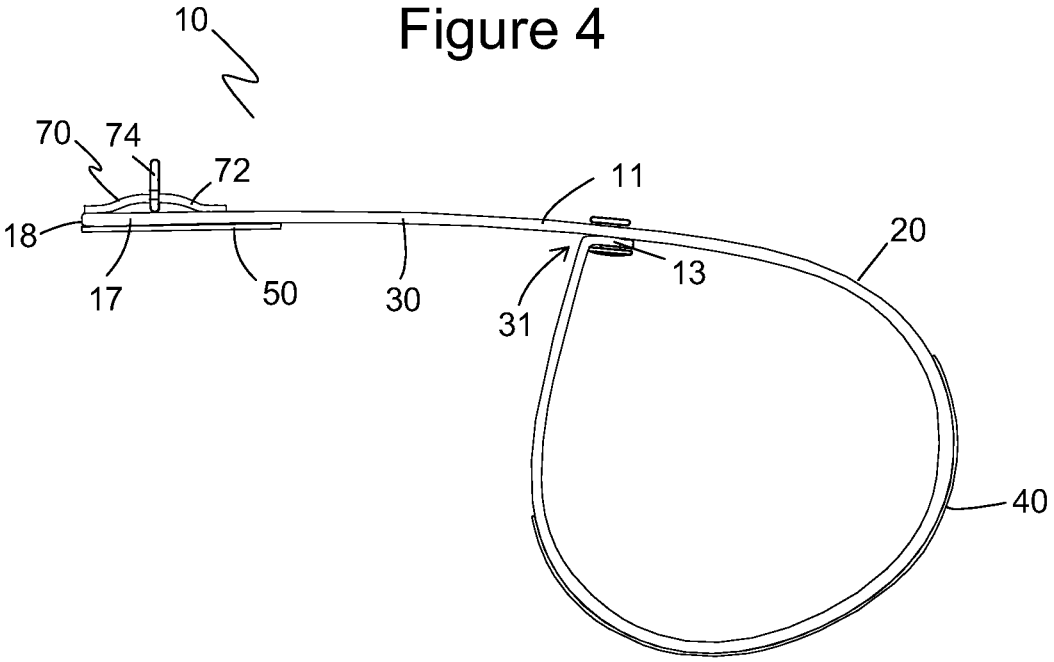
FIG. 4 is a top plan view of the embodiment of FIG. 2.
Figure 5:
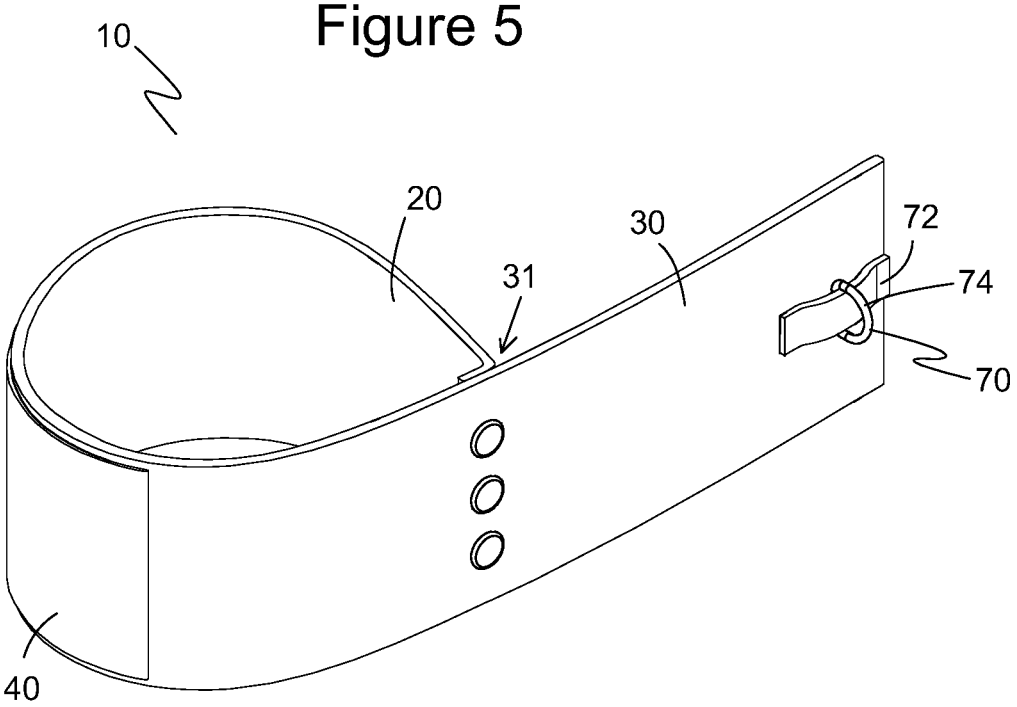
FIG. 5 is a rear perspective view of the embodiment of FIG. 2 showing one embodiment of the lanyard connector assembly.
Figure 6:
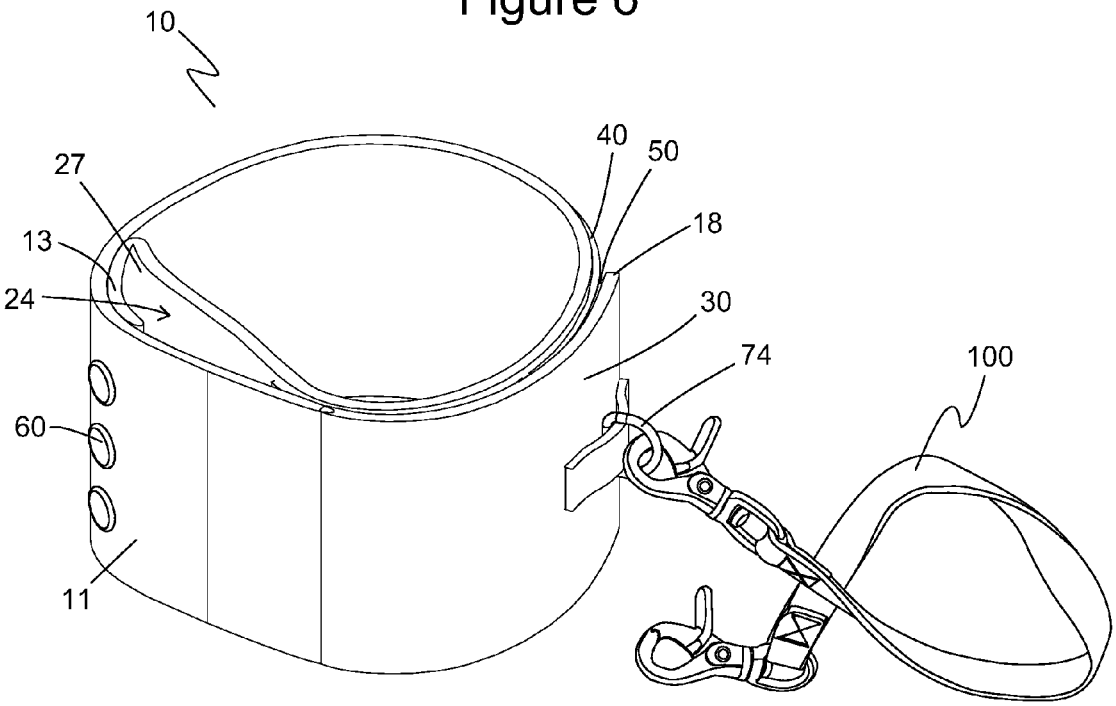
FIG. 6 is a perspective view of another embodiment of a tool lanyard wrist cuff of the present invention shown in a closed position and with a lanyard attached to the lanyard connector.
Figure 7:
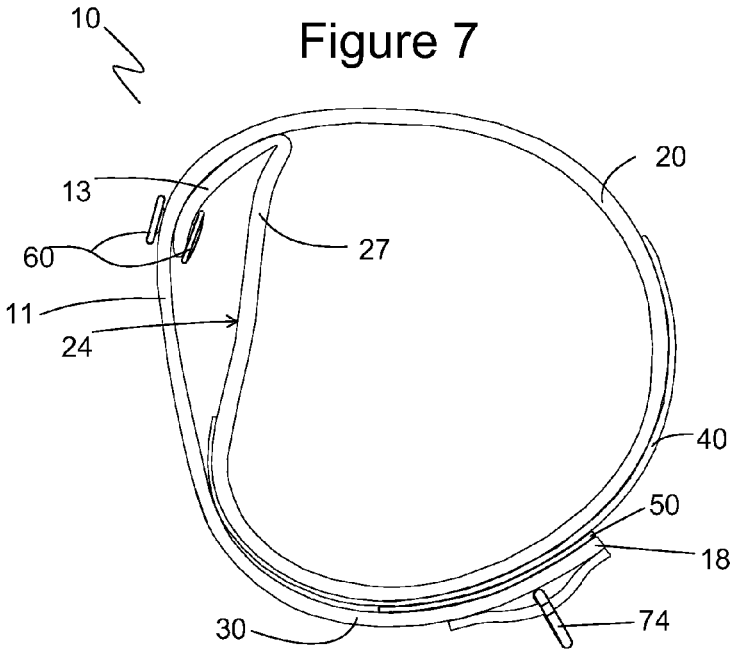
FIG. 7 is a top plan view of the embodiment of FIG. 6 shown without the lanyard.

Referring now to FIGS. 4 and 5, top and rear perspective views, respectively, are illustrated of the embodiment of tool lanyard wrist cuff 10 shown in FIGS. 2-3. Lanyard ring assembly 70 is attached to distal end portion 17 opposite second fastener portion 50 on adjustment tab 30 with a portion of lanyard connector 74 captured by retaining strip 72. First body end 13 is fixedly attached to body portion 11 with first body end 13 directed away from distal end 18. Referring now to FIGS. 6 and 7, perspective and top views, respectively, illustrate another embodiment of tool lanyard wrist cuff 10 shown in a closed position with adjustment tab 30 attached to closed loop band 20. In this embodiment, first body end 13 is fixedly attached to body portion 11 so that first body end 13 is directed towards distal end 18 of adjustment tab 30. FIGS. 6 and 7 illustrates a relatively smaller size of closed loop band 20 where part 27 of closed loop band 20 folds across loop outside surface 24 and attaches second fastener part 50 to first fastener part 40. By being able to fold a portion of closed loop band 20 upon itself with adjustment tab 30, the size of closed loop band 20 can be easily adjusted to comfortably fit around a user's wrist 300 (shown in FIG. 11). Also, because closed loop band 20 folds back on itself, loop fasteners 26, whether releasable or not, are separated from the user's wrist by material of closed loop band at part 27. This configuration results in increased comfort for the user. In FIG. 6, optional lanyard 100 is connected to lanyard connector 74.

Figure 8:
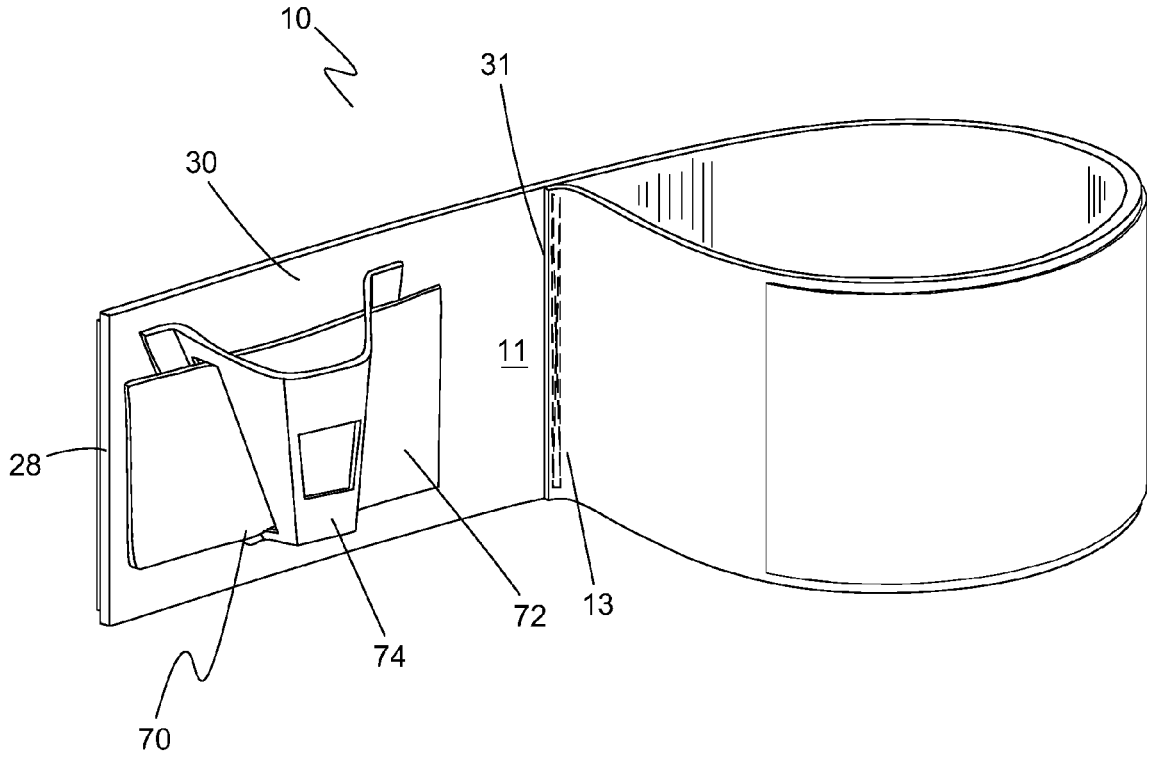
FIG. 8 is a perspective view of another embodiment of the present invention showing the tool lanyard wrist cuff in an open position and equipped with another embodiment of a lanyard connector.

Referring now to FIG. 8, a perspective view shows another embodiment of tool lanyard wrist cuff 10. In this embodiment, lanyard attachment assembly 70 provides a different embodiment of lanyard connector 74 and first body end 13 is fixedly attached by stitching to body portion 11. In this embodiment, retaining strap 72 is approximately 1.5" wide and extends through openings in lanyard connector 74 and longitudinally along most of adjustment tab 30 between distal end 28 and junction point 31. Lanyard connector 74 is a connector having a plurality of openings to accept retaining strap 72 in addition to openings for receiving a compatible tool connector 120 as is known in the art (shown in FIG. 9).

Figure 9:
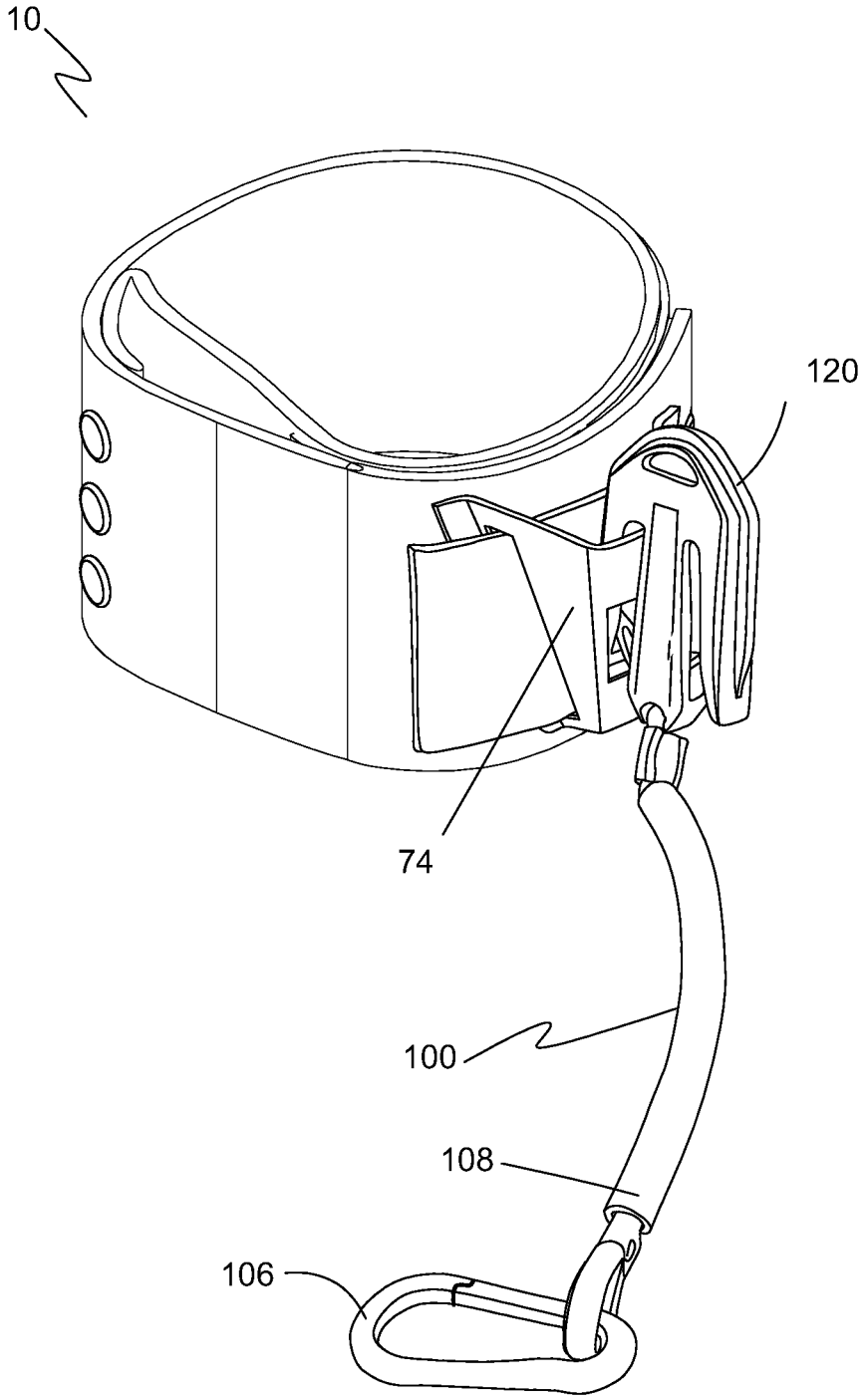
FIG. 9 is a perspective view of another embodiment of a lanyard wrist cuff of the present invention shown in a closed position with a lanyard removably attached to a lanyard connector of the type shown in FIG. 8.

Referring now to FIG. 9, a perspective view illustrates another embodiment of a lanyard wrist cuff shown in a closed position with lanyard 100 attached to lanyard connector 74. Lanyard 100 has a switch-type tool connector 120 of the type shown in FIG. 8 that releasably engages lanyard connector 74 when a similarly configured connector engages the open side 120*b* of switch-type tool connector 120. Lanyard 100 includes a length of sheathed cord or cable and has second connector 106, such as a carabiner, on second lanyard end 108.

One method of making tool lanyard wrist cuff 10 will now be described. A predefined length of a flexible material is obtained to serve as body strip 11, which is used to form closed loop band 20 and adjustment tab 30. A strip of first fastener part 40 (e.g., loop portion of hook-and-loop fastener) is attached (preferably stitched) to body portion 11 towards first body end 13 on a surface that will become loop outside surface 24. A strip of second fastener part 50 (e.g., hook portion of a hook-and-loop fastener) is attached (also preferably sewn) on distal end 18, which will become distal end portion 17 of adjustment tab 30. Second fastener part 50 may be attached to the same or opposite face of body portion 11 as first fastener part 40, depending on which folding direction adjustment tab 30 will be used relative to closed loop band 20 for second fastener part 50 to engage first fastener part 40. First body end 13 is folded onto body portion 11 to define closed loop band 20 with first fastener part 40 on loop outside surface 24 and first body end 13 being positioned at junction point 31 a predefined distance from second end 18. Closed loop band 20 is formed with a size large enough to be capable of sliding over a user's hand for placement on a user's wrist 300. Once the proper size of closed loop band 20 is formed, first body end 13 is stitched to body portion 11 at junction point 31 to form a fixed, closed loop band 20 with adjustment tab 30 extending away at junction point 31.

In another embodiment, first body end 13 is releasably attached to body portion 11 at junction point 31 to form a fixed, but openable, closed loop band 20 with adjustment tab 30 extending away from it at junction point 31. In one embodiment, one or more snaps are used to releasably fix first body end 13 to body strip 11. The length of adjustment tab 30 is chosen so that a sufficient surface area of second fastener part 50 is positioned on inside tab surface 30*a* to securely engage first fastener part 40. The length of adjustment tab 30 is also sufficient to make pulling adjustment tab 30 easier when removing tool lanyard wrist cuff 10. The use of a predefined closed loop band 20 and the folding method of securing tool lanyard wrist cuff 10 provide an adjustable wrist cuff where the snugness of the wrist cuff is infinitely adjustable to a user's preference.

Lanyard attachment assembly 70 is connected to outside tab surface 30*b* at distal end portion 17 of adjustment tab 30. Ring retaining strip 72, which in one embodiment is a piece of ½"-wide webbing, is stitched to extend along or transversely across longitudinal center line 30*c* of adjustment tab 30. Captured in ring retaining strip 72 is lanyard connector 74, which is preferably a D-ring that can be used to tether tools to tool lanyard wrist cuff 10.

Figures 10A, 10B:
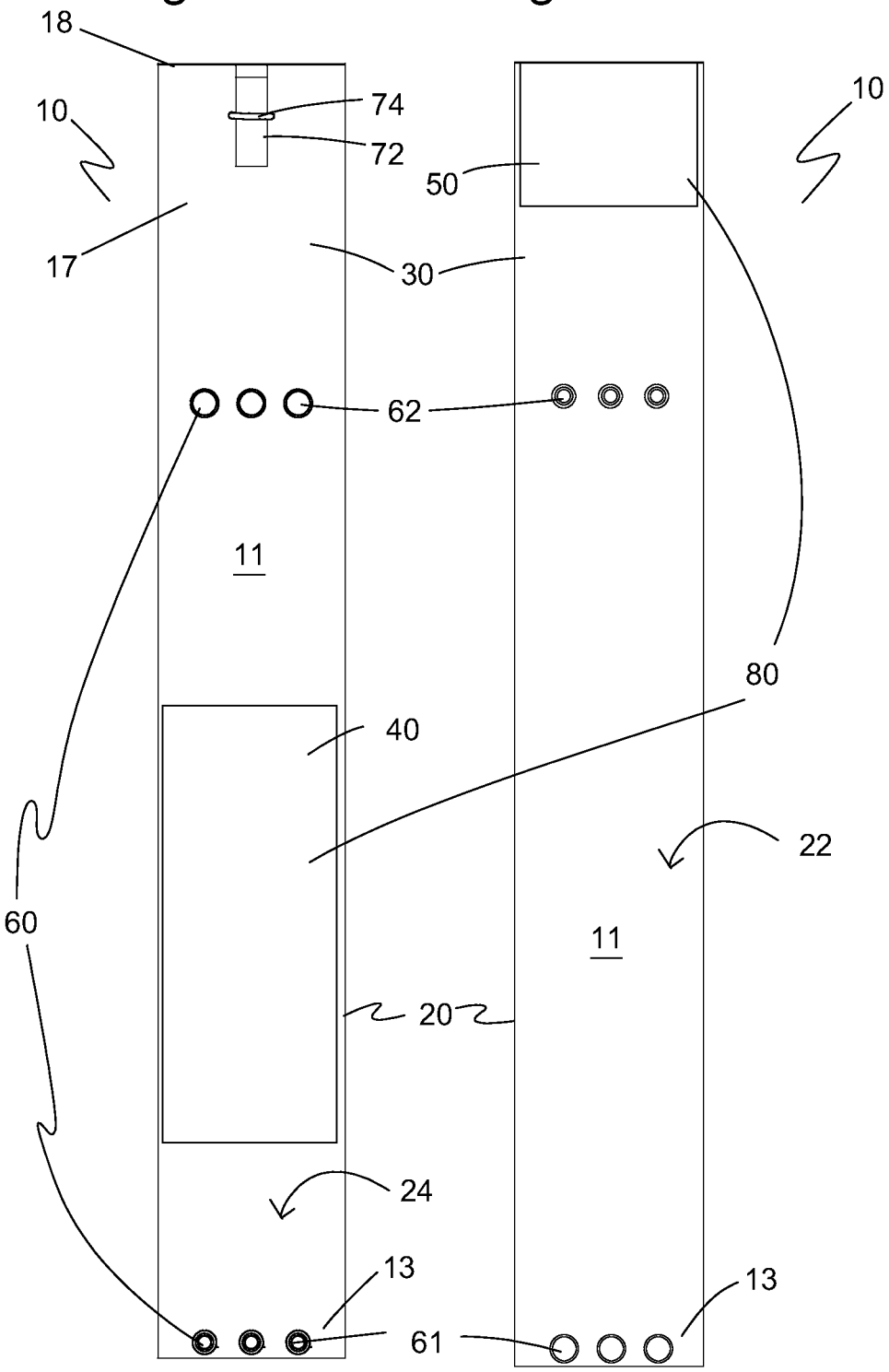
FIG. 10A is plan view of the embodiment of FIG. 2 showing the outside surface of the tool lanyard wrist cuff with the first body end disconnected from the body.
FIG. 10B is a plan view of the embodiment of FIG. 2 showing the inside surface of the tool lanyard wrist cuff with the first body end disconnected from the body.

Turning now to FIGS. 10A and 10B, there is illustrated another embodiment of tool lanyard wrist cuff 10 shown with first body end 13 released or disconnected from body portion 11. FIG. 10A shows outside surface 24 of closed loop band 20; FIG. 10B shows inside surface of closed loop band 20. In this embodiment, fixed closed loop band 20 is not permanently fixed, but is openable to allow the fixed closed loop band 20 to open as shown in FIGS. 10A and 10B without being limited to relying on the loosened permanently fixed closed loop sliding over the hand in an emergency situation.

Accordingly, tool lanyard wrist cuff 10 in this embodiment includes a closed loop band 20 and adjustment tab 30 extending from closed loop band 20. Closed loop band has first body end 13 configured for releasable attachment to body portion 11 using a releasable fixed loop fastener 60. In one embodiment, releasable fixed loop fastener 60 includes a first fixed loop fastener portion 61 fixedly attached proximate to first body end 13. A mating, second fixed loop fastener portion 62 is fixedly attached to body portion 11 a predefined distance from distal end 18 such that the predefined distance defines the size of the closed loop when fastener portions 61, 62 are mated to each other. First fixed loop fastener portion 61 engages second fixed loop fastener portion 62 to form a predefined size of closed loop band 20 so that it can be opened when adjustment tab 30 is pulled with sufficient force to disengage fixed loop fastener portion 61 from second fixed loop fastener portion 62. First body end 13 may meet body portion 11 with loop outside surface 24 against loop inside surface, where first body end 13 points away from distal end 18 (shown, for example, in FIG. 2). Alternately, first body end 13 may be folded over to meet body strip 11 with loop inside surface 22 facing itself, where first body end 13 points towards distal end 18 (shown, for example, in FIG. 1). In either configuration, closed loop band 20 can be folded on itself when adjustment tab 30 is wrapped around and attached to closed loop band 20 using releasable fastener 80.

Similar to embodiments discussed above, first fastener part 40 of releasable fastener 80 is fixedly attached to outside surface 24 of closed loop band and positioned between first and second fixed loop fastener portions 61, 62 as shown in FIG. 10A. Second fastener part 50 is fixedly attached to distal end portion 17 of adjustment tab 30 as shown in FIG. 10B. Thus, in an emergency situation, a sufficient pulling force on tether connector 74 will disengage first fastener part 40 from second fastener part 50 to loosen closed loop band 20 and additionally disengage first fixed loop fastener portion 61 from second fixed loop fastener portion 62 to open closed loop band 20 and allow tool lanyard wrist cuff 10 to separate from the user's wrist.

Figure 11:
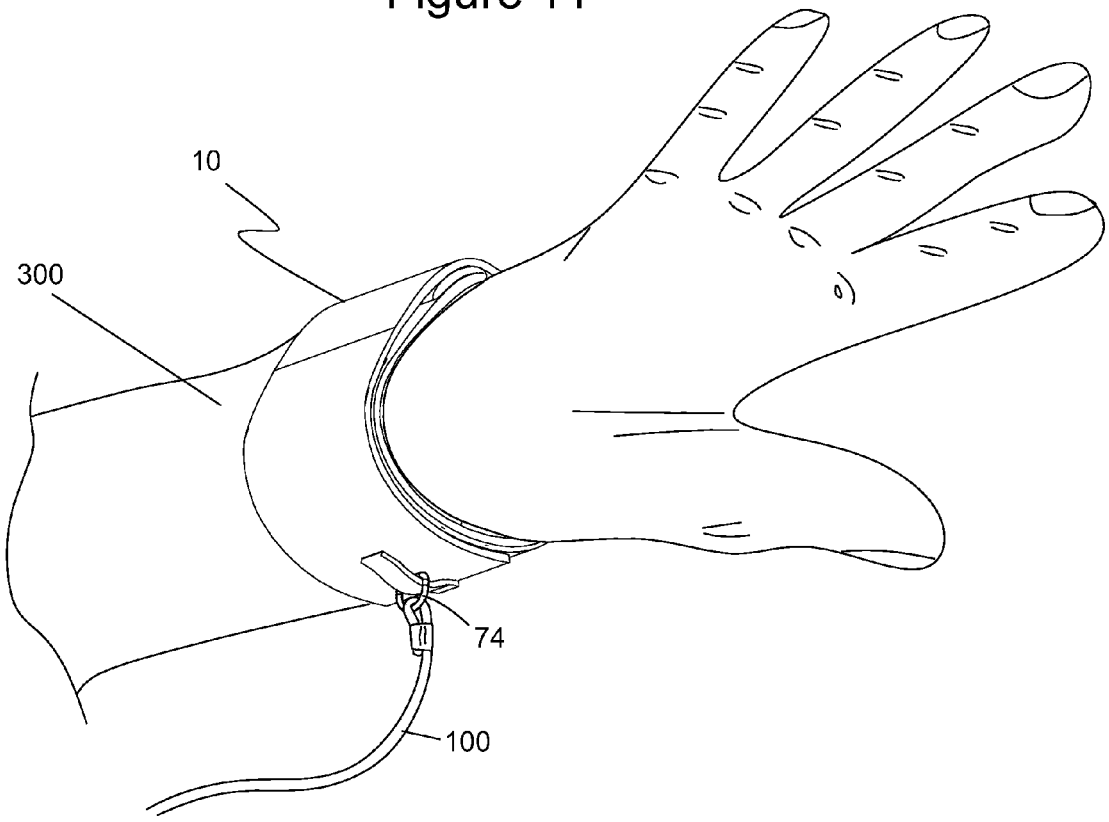
FIG. 11 is an elevational view of the embodiment of FIG. 2 showing a closed position on an user's wrist and with another embodiment of a lanyard attached to the lanyard connector.

Referring now to FIG. 11, an elevational view of the embodiment of FIG. 2 is shown in a closed position on a user's wrist 300. A further embodiment of a lanyard 100 is attached to lanyard connector 74.

Figure 12:
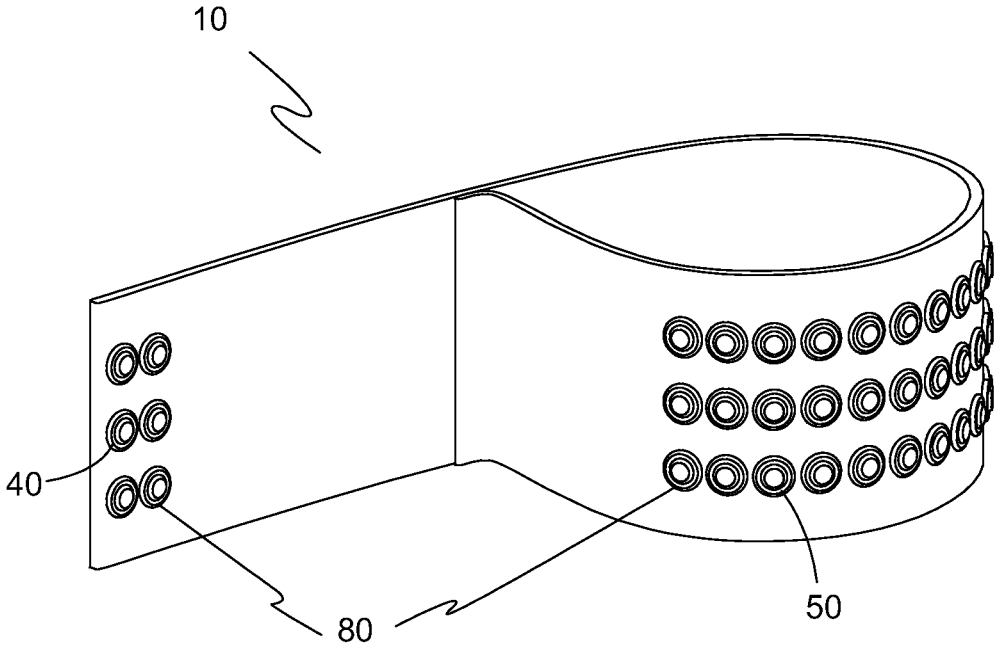
FIG. 12 is a perspective view of another embodiment of a tool lanyard wrist cuff showing snaps for the releasable fastener.

Referring now to FIG. 12, a perspective view illustrates another embodiment of tool lanyard wrist cuff 10 shown with an alternate embodiment of releasable fastener 80. First fastener part 40 and mating second fastener part 50 are snaps. The quantity of snaps used for first fastener part 40 is selected to achieve the desired separation force when first fastener part 40 engages second fastener part 50. As shown in FIG. 12, second fastener part 50 includes a plurality of mating snap portions to enable the user to adjust the fit of tool lanyard wrist cuff 10.

Figure 13:
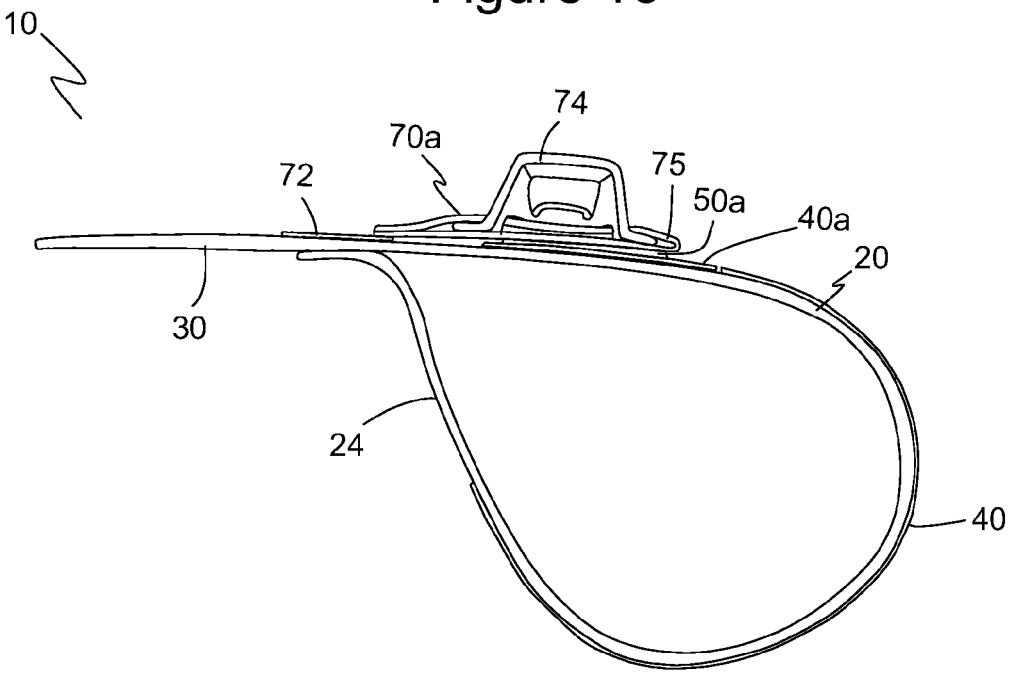
FIG. 13 is a plan view of another embodiment of the tool lanyard wrist cuff of the present invention showing the adjustment tab disconnected from the body and including a breakaway lanyard connector strap releasably attached to the adjustment tab.
Figure 14:
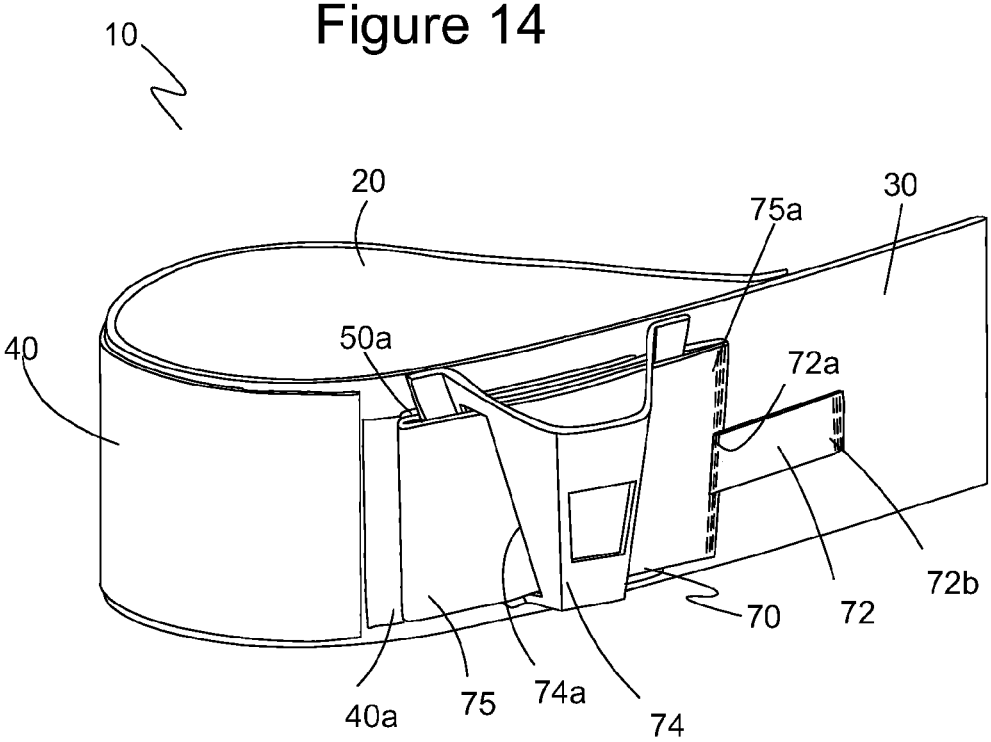
FIG. 14 is a perspective view of the embodiment of FIG. 13 showing the adjustment tab disconnected from the body and the breakaway lanyard connector strap releasably attached to the closed loop band.

Referring now to FIGS. 13 and 14, a top plan view and a perspective view, respectively, illustrate another embodiment of tool lanyard wrist cuff 10 shown with a breakaway lanyard attachment assembly 70*a*. As shown in FIGS. 13-14, breakaway lanyard attachment assembly 70*a* includes a lanyard connector 74 and a breakaway connector strap 75 that forms a closed loop that passes through one or more strap openings 74*a* of lanyard connector 74. Breakaway connector strap 75 is stretchable, such as being made with fabric comprising elastic but may be made of non-stretchable material. Breakaway connector strap 75 connects to closed loop band 20 using connector strap releasable fastener 40*a*. For example, first connector fastener part 40*a* is connected to loop outside surface 24 of closed loop band 20 and second connector fastener part 50*a* is connected to breakaway connector strap 75. In one embodiment, first connector fastener part 40*a* is part of or is an extension of first fastener part 40 on closed loop band 20, but first connector fastener part 40*a* may also be a separate component from first fastener part 40.

Breakaway attachment assembly 70*a* optionally includes a retaining strip 72 fixedly connected between adjustment tab 30 or closed loop band 20 and breakaway connector strap 75. A first strip end 72*a* of retaining strip 72 is fixedly attached to a first end 75*a* of breakaway connector strap 75 and a second strip end 72*b* is fixedly attached to adjustment tab 30 or closed loop band 20 adjacent to adjustment tab 30. First and second strip ends 72*a*, 72*b* are fixedly attached with stitching, a rivet, a staple, a grommet, adhesive, or any other suitable means adequate to endure the force of a dropped object tethered to tool lanyard wrist cuff 10. In this embodiment, retaining strip 72 is made of a stretchable material. When retaining strip 72 is not present, first breakaway strap end 75*a* is fixedly attached to adjustment tab 30 or closed loop band 20, such as by stitching or other methods discussed above.

Being attached to closed loop band 20 with connector releasable fastener 40*a*, breakaway connector strap 75 releases from closed loop band 20 upon being subjected to the force of a dropped tool. This release reduces the tool-drop stresses on lanyard connector 74. Also, being made of a stretchable material, breakaway connector strap 75 further reduces tool-drop stresses on lanyard connector 74. When retaining strip 72 is included and also made of a stretchable material, breakaway lanyard attachment assembly 70*a* further reduces tool-drop stresses on lanyard connector 74 by being able to stretch. Therefore, when a tethered tool is dropped, reduced or no damage is caused to lanyard connector 74 because some of the tool-drop forces are absorbed by the stretch of breakaway connector strap 75 and retaining strip 72 (when present). Thus, first end 75*a* of breakaway connector strap 75 is fixedly attached or secured to adjustment tab 30 or closed loop band 20, for example, either by being directly connected to adjustment tab 30 or closed loop band 20 or by fixedly being connected to retaining strip 72. Other methods of securing breakaway lanyard connector 74 to adjustment tab 30 or closed loop band 20 are also contemplated.

Figure 15:
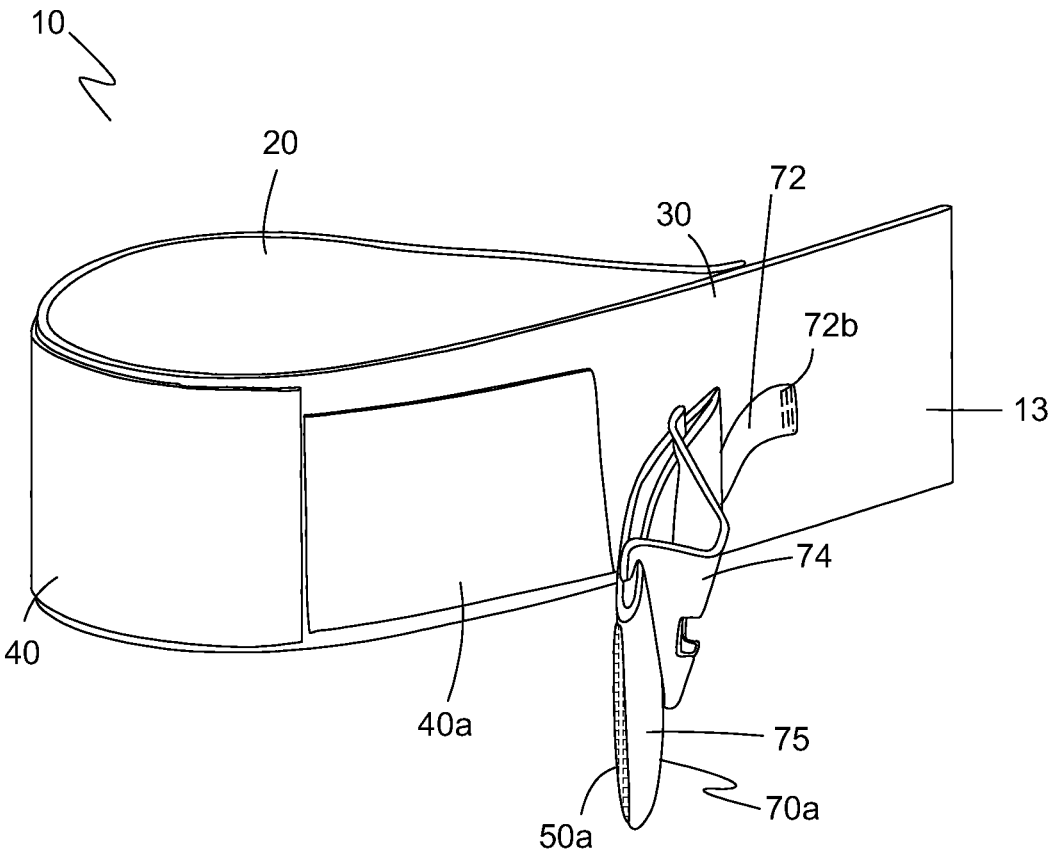
FIG. 15 is a perspective view of the embodiment of FIG. 13 showing the adjustment tab disconnected from the body and the breakaway lanyard connector strap releasably disconnected from the closed loop band.

Referring now to FIG. 15, a perspective view illustrates the embodiment of tool lanyard wrist cuff 10 of FIGS. 13 and 14 shown with breakaway lanyard connector assembly 70*a* released from closed loop band 20. That is, first connector fastener part 40*a* is disconnected from second connector fastener part 50*a*. Second end 72*b* of retaining strip 72 remains attached to adjustment tab 30 when breakaway connector strap 75 is disconnected from closed loop band 20. Second end 72*b* of retaining strip 72 is secured to adjustment tab 30 or closed loop band 20.

To use tool lanyard wrist cuff 10, a user's hand is inserted through closed loop band 20 in its open position and tool lanyard wrist cuff 10 is positioned to be on the user's wrist 300. To tighten tool lanyard wrist cuff 10 about the user's wrist 300, closed loop band 20 is folded over onto itself while simultaneously positioning inside tab surface 30*a* against loop outside surface 24. While maintaining the desired snug fit of closed loop band 20 in its closed position around the user's wrist, second fastener portion 50 on inside tab surface 30*a* of adjustment tab 30 is caused to engage first fastener portion 40 on loop outside surface 24. One end of lanyard 100 is secured to lanyard connector 74 and the opposite end of lanyard 100 is attached to a tool. Preferably, the tool has a mass such that when the tool is dropped a distance equivalent to the length of lanyard 100, releasable fastener 80 does not open. That is, the force of the dropped tool is less than the separation force of releasable fastener 80 when the drop distance is the same or less than the length of lanyard 100.

Because tool lanyard wrist cuff 10 uses a fold-over method to secure tool lanyard wrist cuff 10 to a user's wrist, tool lanyard wrist cuff 10 can be adjusted to the comfort of the user.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tool lanyard wrist cuff comprising:

a fixed closed loop band having a first fastener part of a releasable fastener fixedly attached to a loop outside surface of the closed loop band;

an adjustment tab extending from the closed loop band and having a tab inside surface, a tab outside surface, a distal end portion, and a second fastener part of the releasable fastener fixedly attached to the tab inside surface of the distal end portion, wherein the second fastener part is configured for releasable engagement with the first fastener part when the adjustment tab is folded with the tab inside surface against the loop outside surface to position the second fastener part in engagement with the first fastener part;

a breakaway lanyard connector strap fixedly connected at a first end to the adjustment tab and releasably connected adjacent a second end to the fixed closed loop band by a connector strap releasable fastener, wherein a first connector fastener part of the connector strap releasable fastener is fixedly attached to the breakaway lanyard connector strap and a second connector fastener part of the connector strap releasable fastener is fixedly attached to the closed loop band; and a lanyard connector secured to the breakaway lanyard connector strap.

2. The tool lanyard wrist cuff of claim 1 wherein the connector strap releasable fastener is selected from the group consisting of a snap, a snap button, and a hook-and-loop fastener.

3. The tool lanyard wrist cuff of claim 1 wherein the breakaway lanyard connector strap is made of a material having elastic properties.

4. The tool lanyard wrist cuff of claim 1, wherein the first connector fastener part is a portion of the first fastener part.

5. The tool lanyard wrist cuff of claim 1, further comprising a retaining strip having a first strip end and a second strip end wherein the first strip end is fixedly attached to a first end of the breakaway lanyard connector strap and the second strip end is fixedly attached to the tab outside surface of the adjustment tab or the closed loop band adjacent the adjustment tab.

6. The tool lanyard wrist cuff of claim 5, wherein the retaining strip is made of a material having elastic properties.

7. The tool lanyard wrist cuff of claim 6, wherein a first body end of the closed loop band is openably attached to a body portion of the tool lanyard wrist cuff using a connector selected from the group consisting of break-away stitching, at least one snap, and at least one snap button.

8. The tool lanyard wrist cuff of claim 7 wherein the connector used for openably attaching the first body end to the body portion requires a separation force selected from the group consisting of (i) a separation force that is equal to a separation force of the adjustment tab from the fixed closed loop and (ii) a separation force that is greater than the separation force of the adjustment tab from the fixed closed loop.

9. A method of making a tool lanyard wrist cuff, the method comprising:

folding a strip of material onto itself where a first body end of the strip is spaced from a distal end of the strip;

attaching the first body end of the strip to the strip of material forming a closed loop and a tab with a distal end extending from the closed loop;

securing a first fastener part to an outside surface of the closed loop;

securing a second fastener part to an inside surface of the distal end portion of the tab;

attaching a lanyard connector to a breakaway lanyard connector strap forming a closed loop that passes through one or more strap openings of the lanyard connector;

fixedly attaching a first end of the breakaway lanyard connector strap to the adjustment tab or the closed loop band adjacent the adjustment tab;

releasably attaching the breakaway lanyard connector strap to the closed loop band.

10. The method of claim 9 further comprising selecting the first fastener part, the second fastener part, the first connector fastener part, and the second connector fastener part from the group of releasable fasteners consisting of a snap, a snap button, and a hook-and-loop fastener.

11. The method of claim 9, wherein the step of attaching the first body end includes fixedly attaching the first body end to the strip material.

12. The method of claim 9, wherein the step of attaching the first body end includes openably attaching the first body end to the strip material.

13. The method of claim 12 wherein the step of openably attaching the first body end to the strip material includes selecting a fastener with a separation force from the group consisting of (i) a separation force equal to the separation force required to separate the first fastener part from the second fastener part and (ii) a separation force that is greater than the separation force required to separate the first fastener part from the second fastener part.

14. The method of claim 9, wherein the step of fixedly attaching a first end of the breakaway lanyard connector strap to the adjustment tab or the closed loop band adjacent the adjustment tab includes fixedly attaching a first strip end of a retaining strip to the first end of the breakaway lanyard connector strap and a second strip end of the retaining strip to one of the adjustment tab or the closed loop band adjacent the adjustment tab.

15. The method of claim 9, wherein the step of releasably attaching the breakaway lanyard connector strap to the adjustment tab or the closed loop band adjacent the adjustment tab includes attaching a first connector fastener part of a connector strap releasable fastener to the adjustment tab or the closed loop band adjacent the adjustment tab and attaching a second connector fastener part of the connector strap releasable fastener to the breakaway lanyard connector strap.

16. The method of claim 15, wherein the connector strap releasable fastener is a hook-and-loop fastener.

* * * * *